US008998201B2

(12) United States Patent
Rademakers et al.

(10) Patent No.: US 8,998,201 B2
(45) Date of Patent: Apr. 7, 2015

(54) SHEET RETENTION DEVICE

(71) Applicant: Oce-Technologies B.V., Venlo (NL)

(72) Inventors: Albert W. T. Rademakers, Grubbenvorst (NL); Mark Rietbergen, Grubbenvorst (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 14/310,497

(22) Filed: Jun. 20, 2014

(65) Prior Publication Data

US 2014/0300049 A1 Oct. 9, 2014

Related U.S. Application Data

(63) Continuation of application No. PCT/EP2012/076018, filed on Dec. 18, 2012.

(30) Foreign Application Priority Data

Dec. 23, 2011 (EP) ..... 11195530

(51) Int. Cl.

| | |
|---|---|
| ***B65H 9/00*** | (2006.01) |
| ***B65H 15/00*** | (2006.01) |
| ***B65H 29/40*** | (2006.01) |
| ***B65H 27/00*** | (2006.01) |
| ***B65H 29/14*** | (2006.01) |
| ***B65H 29/52*** | (2006.01) |
| ***B65H 31/26*** | (2006.01) |

(Continued)

(52) U.S. Cl.

CPC ..... *B65H 9/002* (2013.01); *B65H 15/00* (2013.01); *B65H 29/40* (2013.01); *B65H 2301/33214* (2013.01); *B65H 27/00* (2013.01); *B65H 29/14* (2013.01); *B65H 29/52* (2013.01); *B65H 31/26* (2013.01); *B65H 31/34* (2013.01); *B65H 2301/4212* (2013.01); *B65H 2301/4213* (2013.01); *B65H 2404/1141* (2013.01); *B65H 2404/122* (2013.01); *B65H 2404/14211* (2013.01); *B65H 2404/1521* (2013.01); *B65H 2404/611* (2013.01); *B65H 2404/651* (2013.01); *B65H 2701/11312* (2013.01);

(Continued)

(58) Field of Classification Search

CPC .. B65H 15/00; B65H 29/40; B65H 2301/133; B65H 2301/32; B65H 2301/332; B65H 2301/33214; B65H 2801/36; B65H 9/002

USPC ..... 271/65, 186, 187, 315

See application file for complete search history.

(56) References Cited

U.S. PATENT DOCUMENTS 3,917,256 A * 11/1975 Kubasta ..... 271/65
5,620,177 A 4/1997 Takemoto et al.

(Continued)

FOREIGN PATENT DOCUMENTS

JP 3-288762 A 12/1991

*Primary Examiner* — Michael McCullough

(74) *Attorney, Agent, or Firm* — Birch, Stewart, Kolasch & Birch, LLP

(57) ABSTRACT

A sheet retention device is provided for retaining at least one sheet. The sheet retention device comprises a sheet supporting unit for supporting at least a first portion of the sheet, a rotatable guiding unit configured to enclose a second portion of the sheet, an urging unit and a drive unit for in operation controllably rotating the rotatable guiding unit. The rotatable guiding unit comprises a passageway arranged through the rotatable guiding unit, which passageway is configured to enclose the second portion of the sheet, the passageway having an entrance portion at one side of an outer surface of the rotatable guiding unit and an exit portion at another side of an outer surface of the rotatable guiding unit. The exit portion is arranged in the passageway at an opposite end with respect to the entrance portion.

19 Claims, 8 Drawing Sheets

(51) Int. Cl.

| | |
|---|---|
| ***B65H 31/34*** | (2006.01) |
| ***B65H 1/04*** | (2006.01) |
| ***B65H 7/20*** | (2006.01) |

(52) U.S. Cl.

CPC .... *B65H 2701/1313* (2013.01); *B65H 2801/06* (2013.01); *B65H 1/04* (2013.01); *B65H 7/20* (2013.01)

(56) References Cited

U.S. PATENT DOCUMENTS

| | | | | |
|---|---|---|---|---|
| 6,203,007 | B1 * | 3/2001 | Choi | 271/278 |
| 8,840,104 | B2 * | 9/2014 | Fujikake | 271/69 |
| 2010/0109228 | A1 | 5/2010 | Obara | |
| 2010/0244361 | A1 | 9/2010 | Unnasch | |

* cited by examiner

SHEET RETENTION DEVICE

CROSS REFERENCE TO RELATED APPLICATIONS

This application is a Bypass Continuation of PCT International Application No. PCT/EP2012/076018 filed on Dec. 18, 2012, which claims priority under 35 U.S. §119(a) to Patent Application No. 11195530.8 filed in Europe on Dec. 23, 2011, all of which are hereby expressly incorporated by reference into the present application.

FIELD OF THE INVENTION

The present invention relates to a sheet retention device for retaining at least one sheet. The present invention further relates to a method for retaining at least one sheet in a sheet retention device. The present invention further relates to a printer comprising a sheet retention device according to the invention. The present invention further relates to a sheet processing device comprising a sheet retention device according to the invention.

BACKGROUND OF THE INVENTION

In a known stack forming device a traction surface is provided on an outer surface of a roller, which is rotatably driven for moving a sheet into a sheet retaining position. The trailing edge of the sheet is kept in contact with the traction surface during a rotation of the traction surface by providing friction between the sheet and the traction surface, for example by applying a vacuum pressure between the sheet and the traction surface. At some point the trailing edge of the sheet is released and the sheet is propelled into a sheet retaining position.

The known stacking device has the disadvantage that the traction surface provides a limited control over the movement of the sheet into a sheet retaining position during the rotation of the traction surface. Another disadvantage is that the stacking device provides insufficient control of stacking a plurality of sheets, in case the plurality of sheets has a substantial variation in length.

In another stack forming device a rotatable guide structure having paddle arms is used for moving a sheet into a sheet retaining position. The rotation of the paddle arms is controlled so that first the paddle arms support a trailing edge of a sheet during stacker input of a sheet. Thereafter the paddle arms are rotated 360° to clear the trailing edge of the sheet from the stacker input path. Thereby the sheet trailing edge is released towards the top of the sheet stack.

The alternative stack forming device has the disadvantage that the paddle arms provide a limited control over the movement of the sheet into a sheet retaining position. Another disadvantage is that the stacking device provides insufficient control of stacking a plurality of sheets, in case the plurality of sheets has a substantial variation in length.

SUMMARY OF THE INVENTION

It is an object of the present invention to provide a sheet retention device for retaining at least one sheet, which sheet retention device provides improved control over guiding at least one sheet into a sheet retention position and holding the at least one sheet in the retention position.

This object is attained by a sheet retention device for retaining at least one sheet, the sheet retention device comprising a sheet supporting means for supporting at least a first portion of the sheet, a rotatable guiding means configured to enclose a second portion of the sheet, the rotatable guiding means comprising an outer surface and a sheet deflecting surface, such that in operation during at least part of a revolution of the rotatable guiding means a portion of the sheet is guided by the sheet deflecting surface into a sheet retaining position, which sheet retaining position is defined by the outer surface of the rotatable guiding means and an urging means, the urging means being urged against a portion of the outer surface of the rotatable guiding means in said sheet retaining position, and a drive means for in operation controllably rotating the rotatable guiding means, wherein the rotatable guiding means comprises a passageway arranged through the rotatable guiding means, which passageway is configured to enclose the second portion of the sheet, the passageway having an entrance portion at one side of the outer surface of the rotatable guiding means and an exit portion at another side of the outer surface of the rotatable guiding means, said exit portion being arranged in the passageway at an opposite end with respect to the entrance portion.

The sheet supporting means support a first portion of the sheet. The sheet supporting means may be a horizontally aligned platform, or may have an inclined position.

The sheet supporting means may be arranged movably in a direction perpendicular to the plane of the first portion of the sheet. The advantage is that a plurality of sheets may be supported by the sheet supporting means during a stacking operation of the sheet retention device.

The rotatable guiding means enclose a second portion of the sheet. The rotatable guiding means comprise a passageway arranged through the rotatable guiding means configured to enclose the second portion of the sheet. The passageway has an entrance portion at one side of the outer surface of the rotatable guiding means and an exit portion at another side of the outer surface of the rotatable guiding means. Said exit portion is arranged in the passageway at an opposite end with respect to the entrance portion. The sheet supporting means is arranged adjacent to the exit portion of the passageway. The passageway arranged through the rotatable guiding means enables an easy transport of the sheet towards a sheet retaining position without damaging leading edges of incoming sheets. The passageway may provide a substantially linear path for a sheet, and may provide a curved path for a sheet. The entrance portion of the passageway may have a tapered shape, suitable for guiding the sheet into the rotatable guiding means during feeding of the sheet into the entrance portion of the passageway. The passageway may be confined by a supporting surface below the second portion of the sheet and a second surface above the second portion of the sheet.

The second portion of the sheet may be a trailing edge of the sheet, or may be any other part of the sheet. In case the second portion of the sheet is a trailing edge, the sheet supporting means is arranged downstream of the rotatable guiding means. The sheet may extend at one side of the enclosed second portion of the sheet in the passageway, or may extend at both sides of the enclosed second portion of the sheet in the passageway in the feeding direction of the second portion of the sheet.

The rotatable guiding means comprises an outer surface and a sheet deflecting surface. The outer surface of the rotatable guiding means may be substantially circular shaped, oval shaped or may comprise multiple planes, such as for example an octahedron.

The sheet deflecting surface is arranged close to the outer surface and at least partly inside of the rotatable guiding means adjacent to the passageway thereby facing a second portion of the sheet. In particular the sheet deflecting surface is positioned such that in operation a sheet is contacted at the same side of the sheet by both the sheet deflecting surface and the outer surface of the rotatable guiding means.

In particular the rotatable guiding means is rotatable about an axis being substantially parallel to the plane of the second portion of the sheet and perpendicular to the feeding direction of the second portion of the sheet. The rotatable guiding means may comprise a shaft for rotating the rotatable guiding means.

The sheet retaining position is defined by the outer surface of the rotatable guiding means and the urging means. The urging means are urged against a portion of the outer surface of the rotatable guiding means. The urging means may be a spring, such as a leaf spring, a weight, a nip or any other means. The urging means may urge against a portion of the outer surface of the rotatable guiding means by means of an elastic force, a magnetic force, an electrostatic force, an air pressure force, a hydraulic force or any other suitable force. In an embodiment the urging means and the supporting means are fixed to each other.

In an embodiment of the device, the device further comprises a sheet feeding means configured for in operation feeding a sheet in a feeding direction into the rotatable guiding means and through the passageway, the sheet feeding means is arranged upstream of the rotatable guiding means with respect to the feeding direction.

In feeding operation the exit portion of the passageway is arranged downstream with respect to the entrance portion of the passageway in the feeding direction of the sheet through the passageway.

In particular the sheet feeding means may be arrange close to the rotatable guiding means. As a result the sheet, which is feeded into the rotatable guiding means, may extend outside of the rotatable guiding means at the inlet position having a relatively short length with respect to the length of the enclosed second portion of the sheet. As such the extending portion of the sheet may easily be guided into the retaining position.

In another embodiment of the device, the device further comprises a sheet transporting means configured for transporting a sheet in the rotatable guiding means through the passageway wherein the sheet transporting means is arranged inside of the rotatable guiding means. In particular the sheet transporting means is arranged in a position of the rotational axis of the rotatable guiding means. As such the enclosed portion of the sheet may be further transported through the passageway of the rotatable guiding means. As a result a trailing edge of the sheet may be accurately positioned somewhere inside of the rotatable guiding means.

In a further embodiment of the device, the device further comprises control means for controlling the sheet feeding means and the drive means such that in operation the sheet feeding means is able to feed the second portion of the sheet into the rotatable guiding means. The drive means are configured for in operation controllably rotating the rotatable guiding means. The drive means may rotate the rotatable guiding means in a home position, the home position being suitable for feeding a second portion of the sheet into the rotatable guiding means.

In another embodiment of the device, the device further comprises detecting means, being configured to detect a position of the sheet. In particular the detecting means may be configured to detect an edge of the sheet. As a result the detected edge of the sheet may be accurately positioned with respect to the rotatable guiding means and/or the sheet supporting surface. This can also be used to align a plurality of sheets, for example for stacking the sheets in the retaining the position.

In another embodiment of the device, the device is configured to stack a plurality of sheets in the retaining position of the sheet retention device. This has the advantage that a stack of sheets can easily be formed using the simple construction of the sheet retention device.

In another embodiment of the device, the sheet deflecting surface is adjoined with the outer surface of the rotatable guiding means. As a result a sheet is easily guided from the enclosed position inside the rotatable guiding means into the sheet retaining position between the outer surface of the rotatable guiding means and the urging means.

In a particular embodiment of the device, a portion of the sheet deflecting surface is substantially aligned with the adjoining portion of the outer surface of the rotatable guiding means. This has the advantage that during guiding of the sheet the friction is reduced of the sheet near the interface of the sheet deflecting surface with the outer surface.

In a further embodiment of the device, at least a portion of the sheet deflecting surface is provided by an outer surface of a trundle, which sheet deflecting surface extends beyond the adjoining portion of the outer surface of the rotatable guiding means. The trundle may be freely rotatable. During guiding of the sheet along the deflecting surface the rotation of the trundle may adapt to the movement of the sheet. As a result during guiding of the sheet the friction of the sheet against the sheet deflecting surface is even further minimized.

In another embodiment of the device, the rotatable guiding means comprises at least two plates, which at least two plates provide the outer surface and the deflecting surface of the rotatable guiding means, and two brackets enclosing the at least two plates. This enables a simple construction of the rotatable guiding means. The two plates may easily be curved in order to provide the outer surface, the sheet deflecting surface, the supporting surface and the passageway. In an alternative embodiment three, four or more plates may be arranged in order to provide the outer surface, the sheet deflecting surface, the supporting surface and the passageway. For example the outer surface may be provided by two plates, the sheet deflecting surface may be provided by a third plate and the supporting surface may be provided by a fourth plate. The plurality of plates is enclosed by two brackets, each bracket being arranged at an end of the plurality of plates. The brackets are fixed to the plates, thereby fixing the position of the plates with respect to each other. The brackets enable a simple control over the rotational movement of the plurality of plates.

In another embodiment of the device, the rotatable guiding means comprises a plurality of rotational guide elements, the plurality of rotational guide elements being arranged sectional along the rotational axis of the rotatable guiding means, wherein a rotational movement of each of the rotational guide elements is connected to the rotational movement of the rotatable guiding means. In an example the rotational guide elements may be connected to each other by rods. This provides the advantage that in an easy way rotational guide means may be assembled having various length dimensions by using various pluralities of rotational guide elements.

In another aspect of the invention a method is provided for retaining at least one sheet in a sheet retention device, the sheet retention device comprising a rotatable guiding means, wherein the rotatable guiding means comprises an outer surface and a passageway, which is arranged through the rotatable guiding means, the passageway having an entrance portion at one side of the outer surface of the rotatable guiding means and an exit portion at another side of the outer surface of the rotatable guiding means, said exit portion being arranged in the passageway at an opposite end with respect to the entrance portion, the method comprising the steps of a) feeding at least a first portion of a sheet in a feeding direction into the entrance portion of the passageway and through the passageway of the rotatable guiding means such that the first portion of the sheet is supported by a sheet supporting means, which is arranged adjacent to the exit portion of the passageway, and a second portion of the sheet is enclosed by the passageway of the rotatable guiding means, b) urging an urging means against a portion of said outer surface of the rotatable guiding means, thereby defining a sheet retaining position, and c) rotating the rotatable guiding means, such that a portion of the sheet is guided into the sheet retaining position.

During step a) the first portion of the sheet is transported through the passageway of the rotatable guiding means. This has the advantage that the first portion of the sheet is easily fed to the other side of the rotatable guiding means in order to be supported on the sheet supporting means on the other side of the rotatable guiding means opposite of the inlet position of the sheet.

The step b) of urging an urging means against a portion of an outer surface of the rotatable guiding means, may be carried out at any time, may be carried out during step c) and may be carried out after step c). The sheets may be fixed in the sheet retaining position by urging the urging means against a portion of an outer surface of the rotatable guiding means.

In an embodiment of the method, prior to step a) the rotatable guiding means is arranged in a home position being suitable for feeding a second portion of the sheet into the passageway of the rotatable guiding means and for feeding a part of the sheet through the passageway of the rotatable guiding means. In the home position the inlet position of the sheet is aligned with the entrance portion of the passageway of the rotatable guiding means.

In another embodiment of the method, the method further comprising step d) holding the supported first portion of the sheet fixed with respect to the sheet supporting means. This has the advantage that the position of the second portion of the sheet being guided is controlled during rotation of the rotatable guiding means and the final position of the sheet in the sheet retaining position is known beforehand. For example the trailing edge or the front edge of each sheet may be aligned to each other while stacking a plurality of sheets.

In another embodiment of the method, the rotatable guiding means further comprises a deflecting surface and during step c) the deflecting surface is moved along the sheet retaining position thereby guiding a portion of the sheet into the sheet retaining position. This provides the advantage that the sheet is controllably guided into the sheet retaining position.

In another embodiment of the method, the method further comprising step e) detecting the sheet, and wherein step a) further comprises controlling the position of the detected sheet with respect to the sheet supporting means. This provides the advantage that the position of the sheet with respect to the sheet supporting means is known before starting step c).

In another embodiment of the method, wherein step a) and/or step c) are carried out multiple times such that a plurality of sheets is stacked in the sheet retaining position, prior to releasing the stacked plurality of sheets from the sheet retaining position.

A stack of sheets can be formed in the sheet retaining position by subsequently executing step a) and c) for a single sheet multiple times, by executing step a) multiple times prior to performing step c), by subsequently executing step a) and c) for a feeded stack of a plurality of sheets, or by any other combination of the above mentioned embodiments.

In another aspect of the invention a sheet processing device is provided comprising a feeding station for feeding a sheet, a sheet retention device according to the invention for retaining at least one sheet and a sheet delivery station for delivering at least one processed sheet. Such a sheet processing device may be a finishing module.

In another aspect of the invention a printing system is provided comprising a sheet storage module for storing a plurality of sheets, a marking station for marking a sheet, which is fed from the sheet storage module, and a sheet retention device according to the invention for retaining at least one processed sheet. The sheet retention device may retain one processed sheet or stack a plurality of processed sheets.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF EMBODIMENTS

Figure 1A:
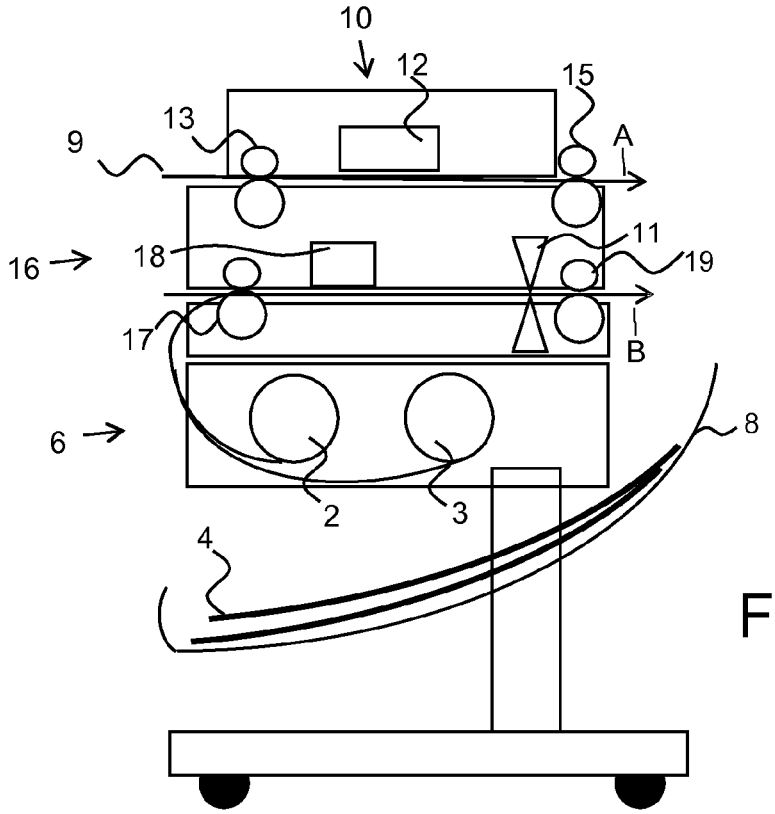
FIG.1A PRIOR ART
FIG. 1A shows a scanning apparatus and imaging apparatus, wherein scanning is achieved using a wide format scanning device

The present invention will now be described with reference to the accompanying drawings, wherein the same reference numerals have been used to identify the same or similar elements throughout the several views.

FIG. 1A shows a prior art wide format scanning and imaging apparatus, wherein scanning is achieved using a wide format scanning device. The scanning apparatus and imaging apparatus comprises a scanning station 10, an imaging station 16 and a media delivery station 8. The scanning station 10 comprises an inlet position 9 for manually feeding an original imaged media to be scanned into the scanning station 10, an image sensor 12 for scanning the image on the media, a media transport pinch 13 for feeding the media along the image sensor 12 in the direction of arrow A and a media transport pinch 15 for moving the scanned original imaged media towards the media delivery station 8.

The imaging station 16 comprises an entrance position for automatically feeding a receiving media from media storage module 6, which comprises two rolls of receiving media 2, 3. The imaging station 16 further comprises a marking element 18 for applying an image on the receiving media, a media transport pinch 17 for transporting the receiving media along the marking element 18 in the direction of arrow B, a cutting means 11 for cutting the processed receiving media at the required length dimension of the processed receiving media and a transport pinch 19 for moving the processed receiving media towards the media delivery station 8.

In the delivery station 8 the plurality of media 4 is gathered, which plurality of media 4 comprises the processed media being processed in the imaging station 16 and/or the scanned media being scanned in the scanning station 10. The position of the plurality of media 4 is not well controlled.

Figure 1B:
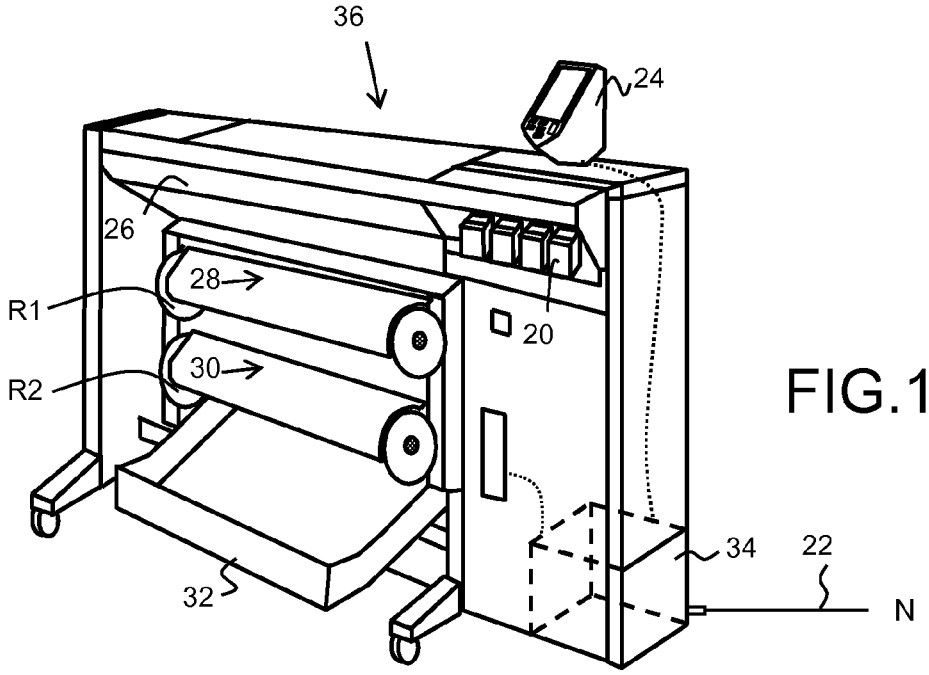
FIG. 1B shows an image forming apparatus, wherein printing is achieved using a wide format inkjet printer

FIG. 1B shows an image forming apparatus 36, wherein printing is achieved using a wide format inkjet printer. The wide-format image forming apparatus 36 comprises a housing 26, wherein the printing assembly, for example an ink jet printing assembly. The image forming apparatus 36 also comprises a storage means for storing image receiving media 28, 30, a delivery station to collect the image receiving media 28, 30 after printing and storage means for marking material 20. In FIG. 1A, the delivery station is embodied as a delivery tray 32. Optionally, the delivery station may comprise processing means for processing the image receiving media 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving media may be used instead of rolls 28, 30 of image receiving media. Printed sheets of the image receiving media, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

Figure 2A:
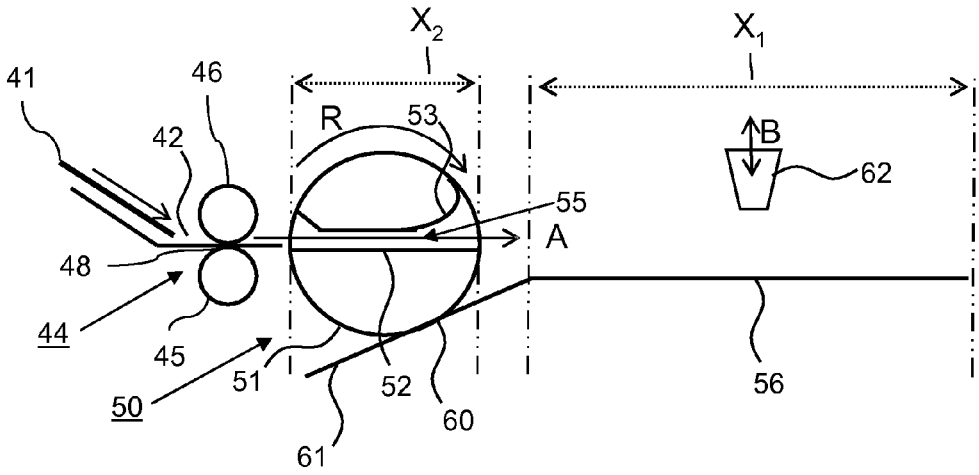
FIG. 2A shows a retention device according to a first embodiment of the invention.

FIG. 2A shows a retention device according to a first embodiment of the invention.

The retention device has an inlet position 42 for a sheet 41, a sheet detector (not shown), a sheet feeding means 44 comprising two rollers 45, 46 which define a pinch 48. The two rollers 45, 46 are rotatable for feeding a sheet in the direction of a rotatable guiding means 50, which is in a home position.

The rotatable guiding means 50 comprises an outer surface 51, a support surface 52 for supporting a portion of the sheet 41, a sheet deflecting surface 53 for guiding a sheet 41, a passageway 55 and a rotation axis along which the rotatable guiding means is rotatable in a direction indicated by arrow x. The passageway 55 provides an opening for feeding the sheet 41 from the sheet feeding means 44 through the rotatable guiding means 50 in the direction of a sheet supporting means 56 indicated by arrow A. By rotation of roller 45 a sheet may be fed through the passageway 55 of the rotatable guiding means 50 in the direction of arrow A. The passageway 55 has the length $X_2$, which defines the maximum length of an enclosed second portion of the sheet 41. The sheet supporting means 56 is provided for supporting a first portion of the sheet 41. The length of the supported first portion of the sheet in this embodiment is $X_1$ at max, depending on the positioning of the sheet 41.

A gripper 62 is positioned above the sheet supporting means 56 and is movable in the direction B of the sheet supporting means for fixing a first portion of the sheet.

An urging means 61 is positioned near the rotatable guiding means 50 urging against a portion of the outer surface of the rotatable guiding means 50, thereby defining a sheet retaining position 60. The urging means 61 in this embodiment is a leaf spring, which is connected to the sheet supporting means 56.

Driving means (not shown) are provided for in operation controllably rotating the rotatable guiding means 50.

Figure 2B:
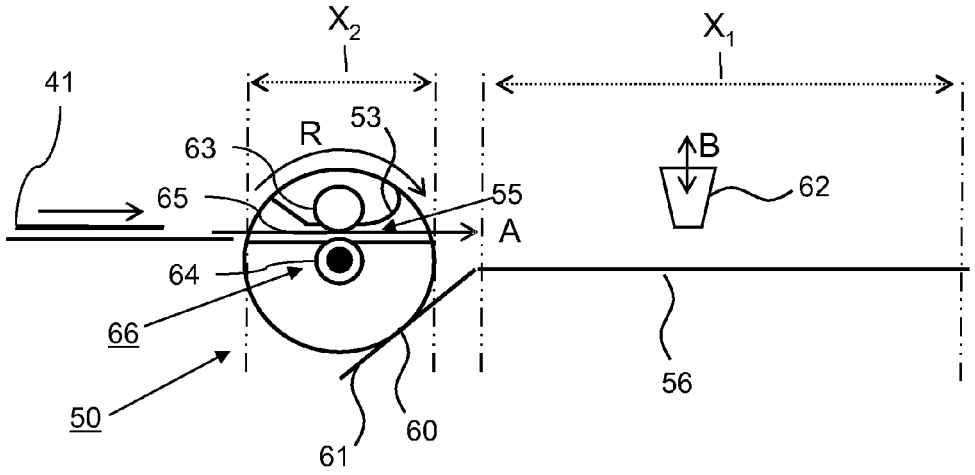
FIG. 2B shows a retention device according to a second embodiment of the invention.

FIG. 2B shows a retention device according to a second embodiment of the invention. The retention device of the second embodiment has no sheet feeding means. The retention device comprises a sheet transporting means 66 inside the rotatable guiding means 50. The rotatable guiding means 50 comprises an outer surface 51, a support surface 52 for supporting a portion of the sheet, a sheet deflecting surface 53 for guiding a sheet, a rotation axis along which the rotatable guiding means is rotatable in the direction indicated by arrow R and a passageway 55. In an alternative embodiment sheet feeding means may further be provided. The sheet transporting means 66 comprises two rollers 63, 64 which define a pinch 65 inside the passageway 55. Roller 63 is rotatably driven. Roller 64 is free rotatable. By rotation of roller 63 a sheet may be moved through the passageway 55 of the rotatable guiding means 50 in the direction of arrow A.

A sheet supporting means 56 is provided for supporting a first portion of the sheet 41. The length of the supported first portion of the sheet in this embodiment is $X_1$ at max, depending on the positioning of the sheet 41.

A gripper 62 is positioned above the sheet supporting means 56 and is movable in the direction B of the sheet supporting means for fixing a first portion of the sheet.

An urging means 61 is positioned near the rotatable guiding means 50 urging against a portion of the outer surface of the rotatable guiding means 50, thereby defining a sheet retaining position 60. The urging means 61 in this embodiment is a leaf spring, which is connected to the sheet supporting means 56. Driving means (not shown) are provided for in operation controllably rotating the roller 63.

FIG. 3A-3E shows the method for retaining at least one sheet in a sheet retention device according to the first embodiment of the invention.

Figure 3A:
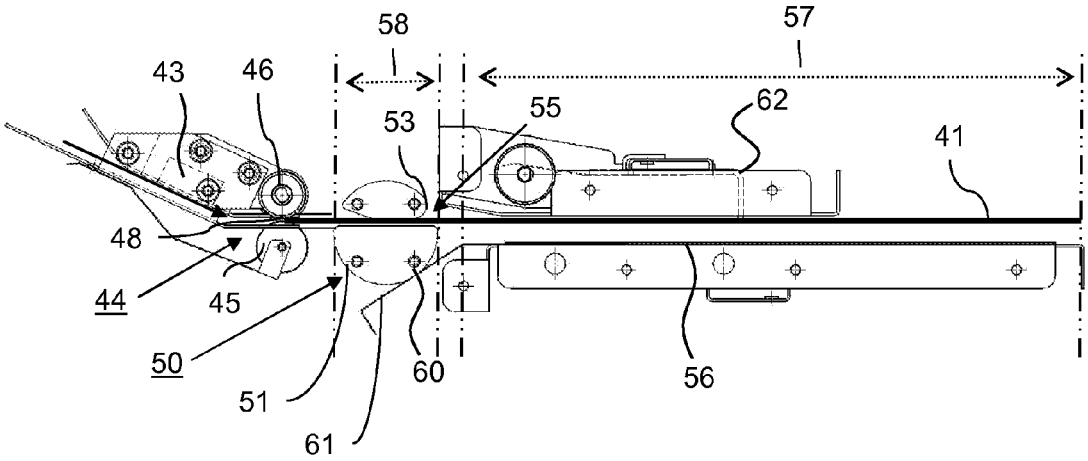
FIG. 3A-3F shows the method for retaining at least one sheet in a sheet retention device according to the first embodiment of the invention.

FIG. 3A shows a first stage of the method for retaining at least one sheet in a sheet retention device according to the first embodiment of the invention.

In this first stage the sheet 41 has been fed by the sheet feeding means 44 through passageway 55 until the trailing edge has reached the pinch 48. The first portion of the sheet 57 is now supported on the sheet supporting means 56 and the second portion of the sheet 58 is now enclosed by the rotatable guiding means 50. The sheet supporting means 56 in this embodiment is long enough to support the leading edge of the sheet 41. In an alternative embodiment the leading edge of the sheet may extend beyond the sheet supporting means 56. An edge detection means 43 is provided upstream of the sheet feeding means 44 in order to accurately position the trailing edge of the sheet with respect to the pinch 48 and the passageway 55 of the rotatable guiding means 50. Alternatively a sheet detection means may be provided near the rotatable guiding means 50 or the sheet supporting means 56 in order to detect the sheet.

The urging means 61 is positioned near the rotatable guiding means 50 urging against a portion of the outer surface 51 of the rotatable guiding means 50, thereby defining a sheet retaining position 60.

Figure 3B:
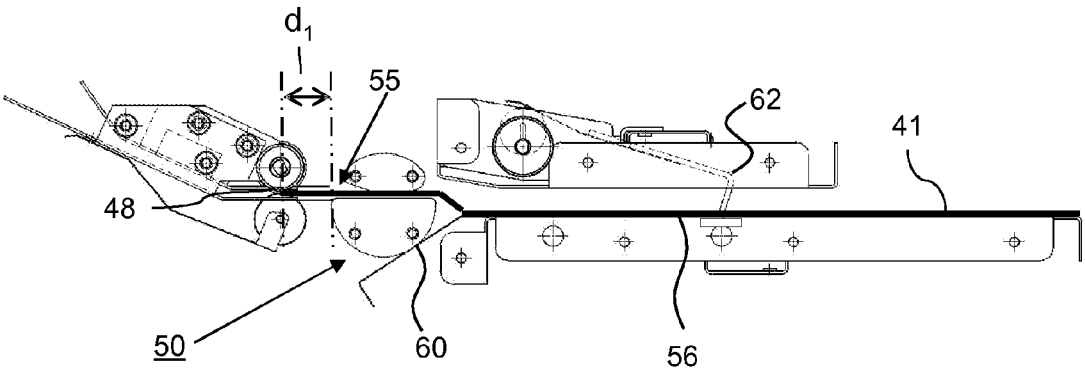

FIG. 3B shows a second stage of the method for retaining at least one sheet in a sheet retention device according to the first embodiment of the invention. In this second stage the gripper 62 is moved down, thereby fixing the first portion of the sheet 41 on the sheet supporting surface 56. The sheet 41 is still fixed in the sheet feeding pinch 48 in this position. The distance $d_1$ of the pinch 48 to the outer surface of the rotatable guiding means 50 is selected, such that the trailing edge of the sheet does not extend too much from the passageway 55 during the process of guiding the sheet 41 to the sheet retention position 60.

Figure 3C:
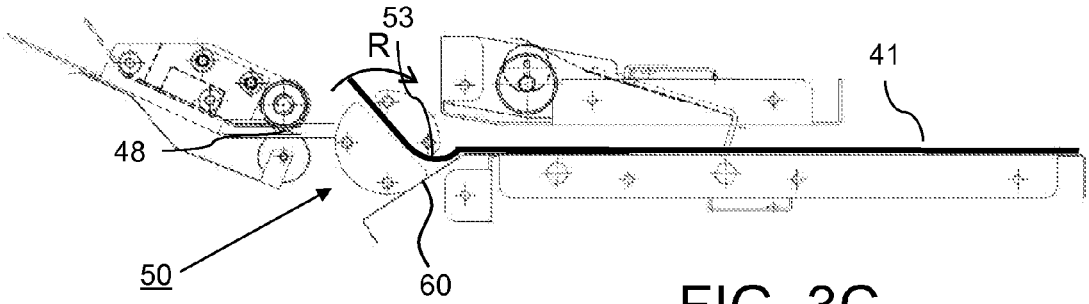

FIG. 3C shows a fourth stage of the method for retaining at least one sheet in a sheet retention device according to the first embodiment of the invention. In this fourth stage first the sheet 41 is released in pinch 48, such that the trailing edge of the sheet 41 can move freely. The rotatable guiding means 50 is rotated by driving means in the direction of arrow R over an angle of about 45 degrees such that a portion of the sheet 41 is contacted by the sheet deflecting surface 53. The sheet deflecting surface guides the sheet in the direction of the sheet retaining position 60. During rotation of the rotatable guiding means 50, the sheet 41 moves along the sheet deflecting surface 53. The sheet deflecting surface 53 in this embodiment has a convex shape, such that the moving sheet is not obstructed nor damaged by the sheet deflecting surface 53. In an embodiment the sheet deflecting surface 53 has a modified surface for reducing a surface Coefficient of Friction (COF), for example the sheet deflecting surface 53 may comprise a polymer fluoroalkylene material such as TEFLON.

Figure 3D:
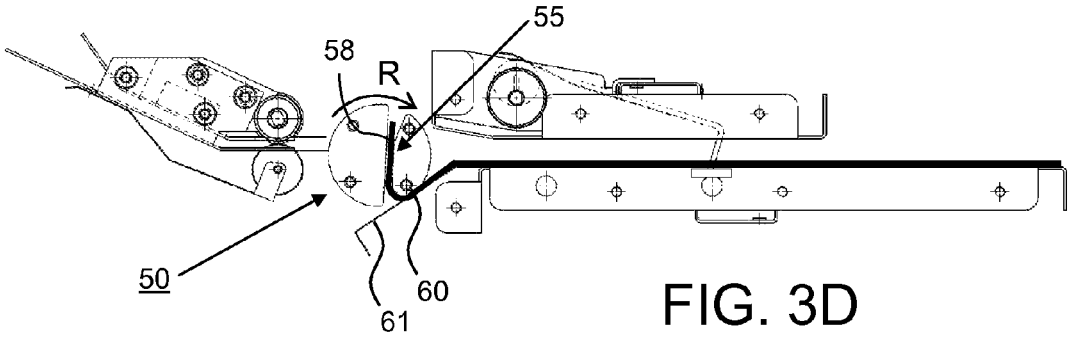

FIG. 3D shows a fifth stage of the method for retaining at least one sheet in a sheet retention device according to the first embodiment of the invention. In this fifth stage the rotatable guiding means 50 is further rotated by driving means in the direction of arrow R over an angle of about 45 degrees such that the sheet deflecting surface 53 has moved near the sheet retaining position 60. A portion of the sheet is now positioned in the sheet retaining position and is fixed by the urging means 61. The second portion of the sheet 58 has partly been moved out of the passageway 55.

Figure 3E:
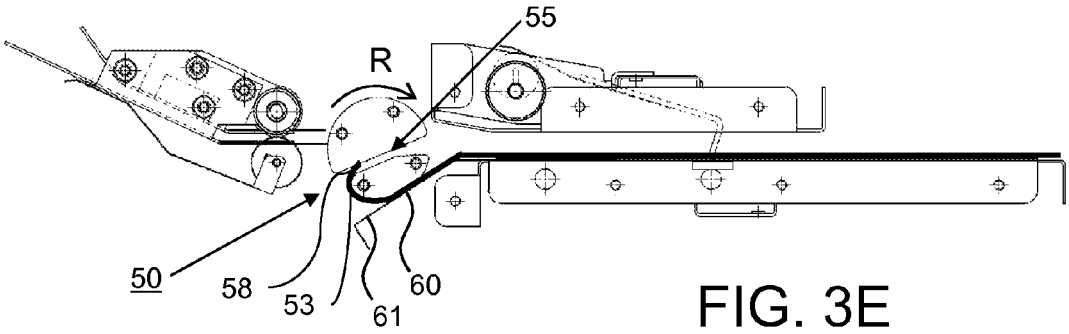

FIG. 3E shows a sixth stage of the method for retaining at least one sheet in a sheet retention device according to the first embodiment of the invention. In this sixth stage the rotatable guiding means 50 is further rotated by driving means in the direction of arrow R over an angle of about 45 degrees such that the sheet deflecting surface 53 has moved past the sheet retaining position 60. The second portion of the sheet 58 has almost been removed from the passageway 55. The trailing edge of the sheet may or may not in this position now flip about 180 degrees towards the urging means 61, depending on the stiffness of the sheet, whereby the sheet is completely removed from the passageway 55.

Figure 3F:
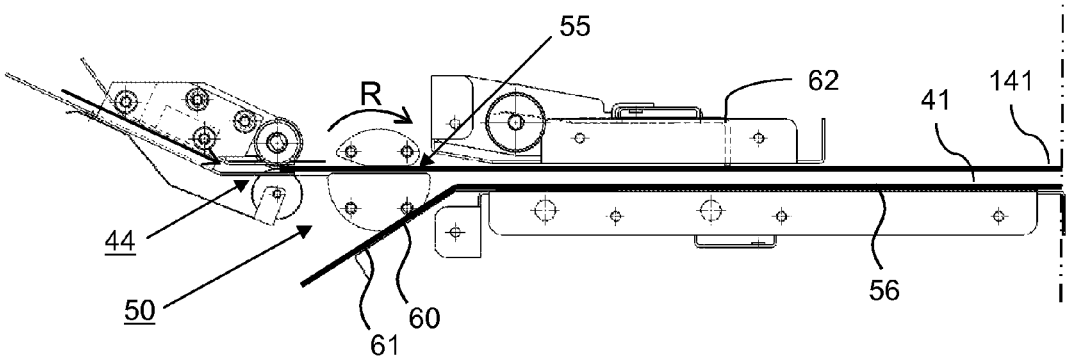

FIG. 3F shows a seventh stage of the method for retaining at least one sheet in a sheet retention device according to the first embodiment of the invention. In this seventh stage the rotatable guiding means 50 is further rotated by driving means in the direction of arrow R over about 135° such that the rotatable guiding means is again in a home position. The home position is suitable for feeding another sheet into the retention device. The gripping 62 is moved up, thereby releasing the first portion of the sheet 41. Subsequently a second sheet 141 may be fed by sheet feeding means 44 through the passageway 55 of the rotatable guiding means 50.

By further performing the stages shown in FIG. 3A-3E the second sheet is retained in the sheet retaining position 60. As a result a stack of two sheets is formed. A stack of a plurality of more than two sheets may be formed by performing the sequence of stages shown in FIG. 3A-3E a multiple times.

Alternatively in a first stage of the method a plurality of sheets may be fed by sheet feeding means 44 through the passageway 55 of the rotatable guiding means 50 and positioned inside the passageway 55 and on the sheet supporting means 56 before executing the guiding of the plurality of sheets to the sheet retaining position 60 in the stages shown in FIGS. 3B-3E. The feeding of a plurality of sheets during the first stage may be performed by feeding a stack of sheets at once through nip 48.

The maximum possible number of sheets being retained by the sheet retaining device in one revolution of the rotatable guiding means 50 depends on the thicknesses of the plurality of sheets and the height of the passageway 55.

Figure 4A:
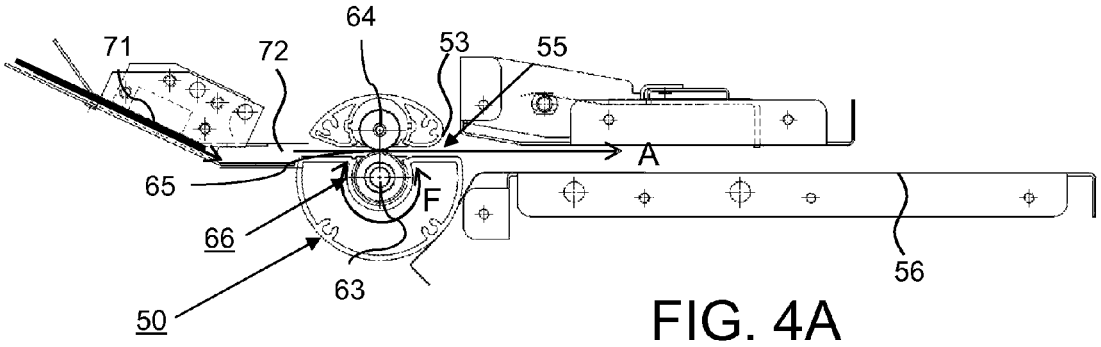
FIG. 4A-4C shows the method for retaining at least one sheet in a sheet retention device according to the second embodiment of the invention.
Figure 4B:
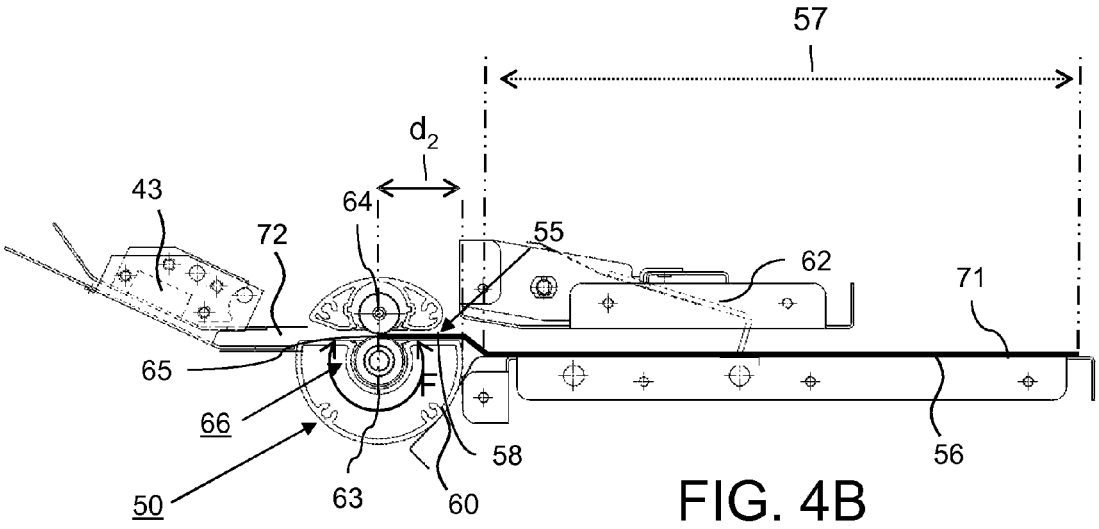
Figure 4C:
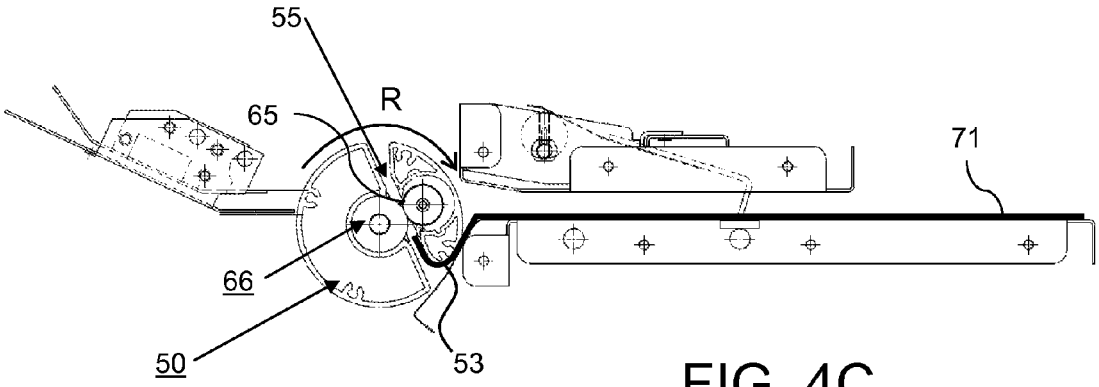

FIG. 4A-4C shows the method for retaining at least one sheet in a sheet retention device according to the second embodiment of the invention.

FIG. 4A shows a first stage of the method for retaining at least one sheet in a sheet retention device according to the second embodiment of the invention. In this first stage a sheet 71 is fed from the inlet position 72 of the passageway 55 of the rotatable guiding means 50 towards the sheet transporting means 66. The feeding of the sheet may be carried out by a sheet feeding means (not shown), may be carried out by gravity or any other means. The sheet transporting means 66 comprises two rollers 63, 64 which define a pinch 65 inside the passageway 55. Roller 63 is rotatably driven. Roller 64 is free rotatable. By rotation of roller 63 (indicated by arrow F) the sheet 71 is moved through the passageway 55 of the rotatable guiding means 50 in the direction of arrow A.

FIG. 4B shows a second stage of the method for retaining at least one sheet in a sheet retention device according to the second embodiment of the invention. In this second stage the sheet 71 is accurately positioned by the sheet transporting means 66 by rotation of roller 63 (indicated by arrow F). An edge detection means 43 is provided upstream of the sheet inlet position 72 in order to accurately position the trailing edge of the sheet with respect to the pinch 65 and the passageway 55 of the rotatable guiding means 50. Alternatively a sheet detection means may be provided near the rotatable guiding means 50 or the sheet supporting means 56 in order to detect the sheet.

The rotation of the roller 63 may be driven in both directions in order to accurately position sheet 71. The distance $d_2$ of the pinch 65 to the outer surface of the rotatable guiding means 50 is smaller than the length of the passageway 55. As a result the sheet 71 may be positioned such that the trailing edge of the sheet is positioned inside of the passageway 55, and the sheet may be positioned such that the enclosed second portion of the sheet is shorter than the passageway 55. This provides the advantage that the second portion of the sheet 58 may be short and the retaining position 60 may be provided very close to the exit side of the passageway 55 in the home position of the rotatable guiding means 50.

After positioning of the sheet the gripper 62 is moved down, thereby fixing the first portion of the sheet 57 on the sheet supporting surface 56.

FIG. 4C shows a third stage of the method for retaining at least one sheet in a sheet retention device according to the second embodiment of the invention. In this third stage the sheet 71 is released in pinch 65, such that the sheet 71 can move freely inside passageway 55. The rotatable guiding means 50 is rotated by driving means in the direction of arrow R over an angle of about 45 degrees such that a portion of the sheet 71 is contacted by the sheet deflecting surface 53. The sheet deflecting surface guides the sheet in the direction of the sheet retaining position 60. During rotation of the rotatable guiding means 50, the sheet 71 moves along the sheet deflecting surface 53. Further stages of the method of the second embodiment are similar to the ones shown in FIGS. 3C-3F of the method of the first embodiment.

Figure 5A:
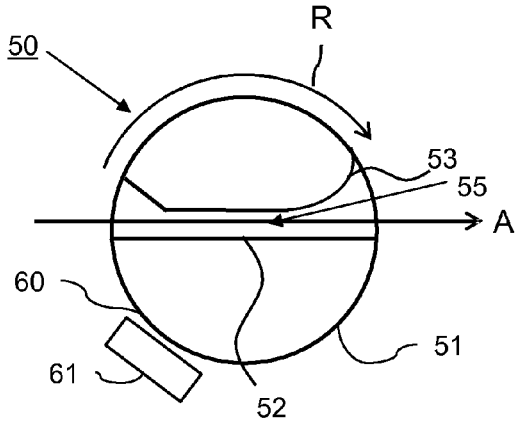
FIG. 5A-5D shows the retention device according to the third—sixth embodiment of the invention.

FIG. 5A-5E shows the retention device according to the third—sixth embodiment of the invention. FIG. 5A shows a rotatable guiding means 50 in a home position, comprising an outer surface 51, a support surface 52 for supporting a portion of the sheet, a sheet deflecting surface 53 for guiding a sheet, a rotation axis (indicated by arrow R) and a passageway 55. The urging means 61 is arranged near the entrance of the passageway 55 below the passageway 55 of the rotatable guiding means 50. This provides the advantage that the sheets may be retained in an area below the rotatable guiding means 50. The rotatable guiding means 50 is rotated clockwise in order to guide a sheet into the sheet retaining position 60.

Figure 5B:
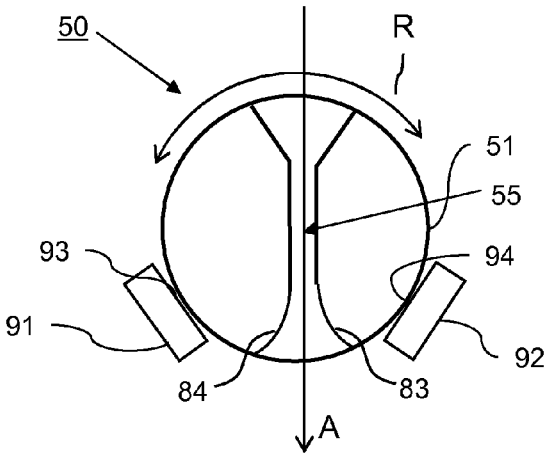

FIG. 5B shows a rotatable guiding means 50 in a home position, comprising an outer surface 51, a passageway 55, two sheet deflecting surfaces 83, 84 for guiding a sheet and a rotation axis (indicated by arrow R). The home position of the rotational guiding means 50 is vertical. Two urging means 91, 92 are provided at both sides of the passageway 55, both urging against a portion of the outer surface 51 of the rotatable guiding means 50, thereby defining two sheet retention positions 93, 94. The rotatable guiding means 50 may rotated clockwise in order to guide a sheet by sheet deflecting surface 83 into the sheet retaining position 93. Or the rotatable guiding means 50 may be rotated counter-clockwise in order to guide a sheet by sheet deflecting surface 84 into the sheet retaining position 94.

Figure 5C:
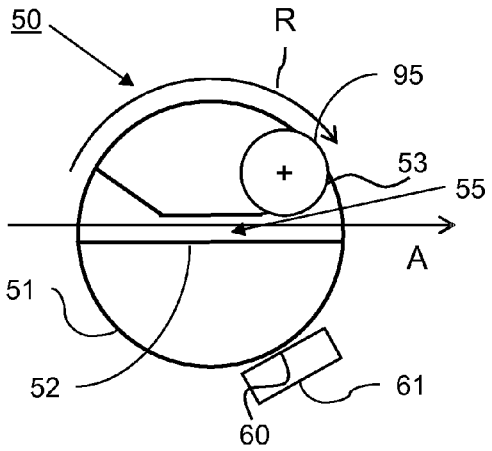

FIG. 5C shows a rotatable guiding means 50 in a home position, comprising an outer surface 51, a support surface 52 for supporting a portion of the sheet, a sheet deflecting surface 53 for guiding a sheet, a rotation axis (indicated by arrow R) and a passageway 55. The sheet deflecting surface 53 is provided by a trundle 95. The trundle 95 is a free rotatable roller. The outer surface of the trundle 95 extends beyond a portion of the outer surface 51 of the rotatable guiding means 50. The urging means 61 is arranged near the exit of the passageway 55 below the passageway 55 of the rotatable guiding means 50.

The rotatable guiding means 50 is rotated clockwise in order to guide a sheet by sheet deflecting surface 53 of trundle 95 into the sheet retaining position 60. As the trundle 95 is freely rotatable, during guiding of the sheet along the sheet deflecting surface 53 the rotation of the trundle may adjust to the moving of the sheet along the sheet deflecting surface induced by the friction force of the sheet against the outer surface of the trundle 95. The advantage is that both the sheet deflecting surface 53 and the sheet is almost not loaded nor damaged also during prolonged use.

Figure 5D:
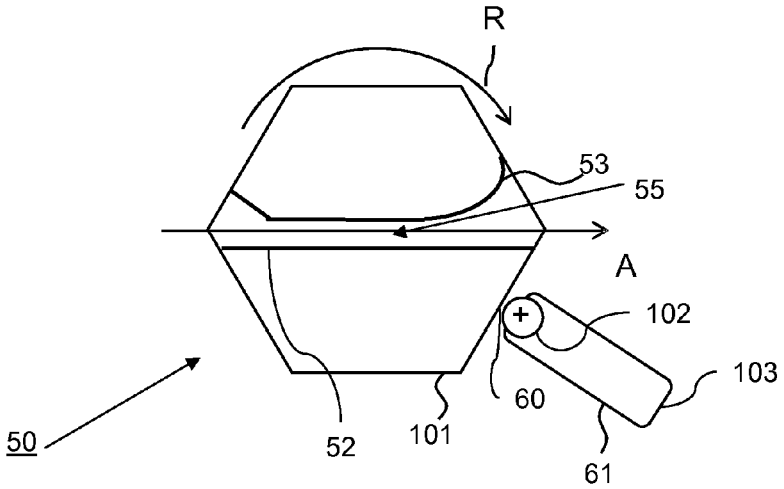

FIG. 5D shows a rotatable guiding means 50 in a home position, comprising an outer surface 101, a support surface 52 for supporting a portion of the sheet, a sheet deflecting surface 53 for guiding a sheet, a rotation axis (indicated by arrow R) and a passageway 55. The outer surface 101 of the rotatable guiding means 50 has a hexagonal shape. The urging means 61 is arranged near the entrance of the passageway 55 below the passageway 55 of the rotatable guiding means 50. The urging means 61 comprises a free rotatable ball 102, which is maintained at the same position by an urging element 103, which urges the free rotatable ball 102 against a portion of the outer surface 101 of the rotatable guiding means 50. The rotatable guiding means 50 is rotated clockwise in order to guide a sheet into the sheet retaining position 60. During rotation of rotatable guiding means 50 the free rotatable ball 102 follows the shape of the outer surface 101.

Figure 6A:
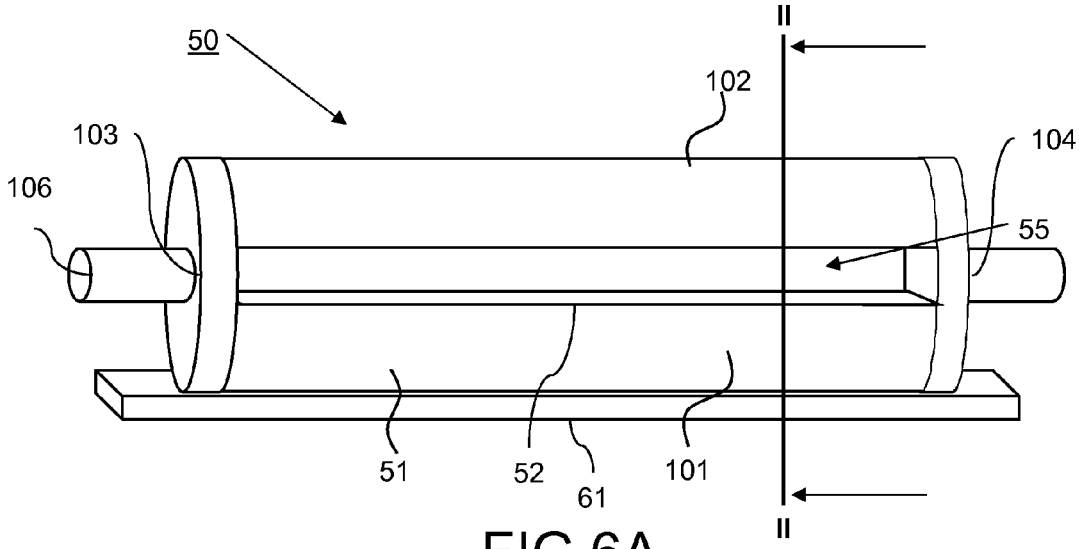
FIG. 6A shows a three-dimensional impression of the construction of the rotatable guiding means according to the seventh embodiment of the invention.

FIG. 6A shows a three-dimensional impression of the construction of the rotatable guiding means 50 and urging means 61 according to the seventh embodiment. In FIG. 6A the rotatable guiding means 50 comprises two plates 101, 102, two brackets 104, 105 and a shaft 106. The two plates 101 and 102 are curved such that together they provide an outer surface 51 and a passageway 55. The urging means 61 is urged against the outer surface 51 of the rotational guiding means 50. The plate 102 further provides a convex shaped sheet deflecting surface (not shown). The plate 101 further provides a supporting surface 52 for supporting the enclosed portion of the sheet. The two brackets 104, 105 enclose the two plates 101 and 102. The shaft 106 is connected to the two brackets at both ends of the rotatable guiding means 50. Driving means (not shown) are provided to controllably rotate shaft 106, thereby rotating the rotatable guiding means 50.

Figure 6B:
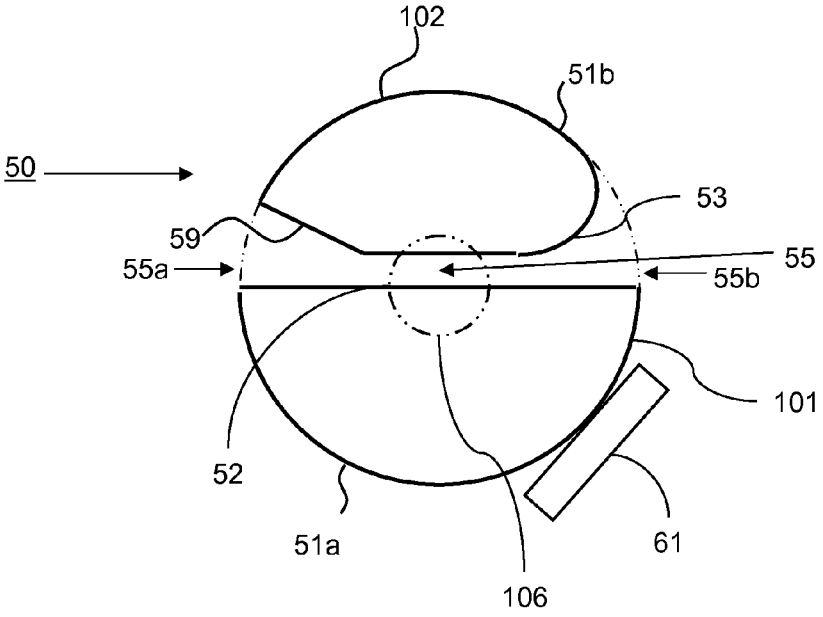
FIG. 6B shows an enlarged side view along the line II-II in FIG. 6A of the seventh embodiment of the invention.

FIG. 6B shows an enlarged side view along the line II-II in FIG. 6A of the rotatable guiding means 50 of the seventh embodiment of the invention. Rotatable guiding means 50 comprises plates 101 and 102, which together define a passageway 55 for moving a sheet through the rotatable guiding means. Plate 101 provides a first portion of the outer surface 51*a* and a supporting surface 52 for supporting an enclosed portion of a sheet. Plate 102 provides a second portion of the outer surface 51*b*, a sheet deflecting surface 53 for guiding a sheet at the exit portion 55*b* of the passage way 55 and a tapered surface 59 at the entrance portion 55*a* of the passageway 55 for guiding an incoming sheet into the passageway 55. The rotatable guiding means further comprises a rotatable shaft 106, which is arranged at the center of the rotatable guiding means 50. In an alternative embodiment the passageway 55 may be arranged offset from the rotational axis of the rotatable guiding means 50, such that the shaft 106 may be provided inside and in the center of the rotatable guiding means without obstructing the passageway 55.

Figure 7:
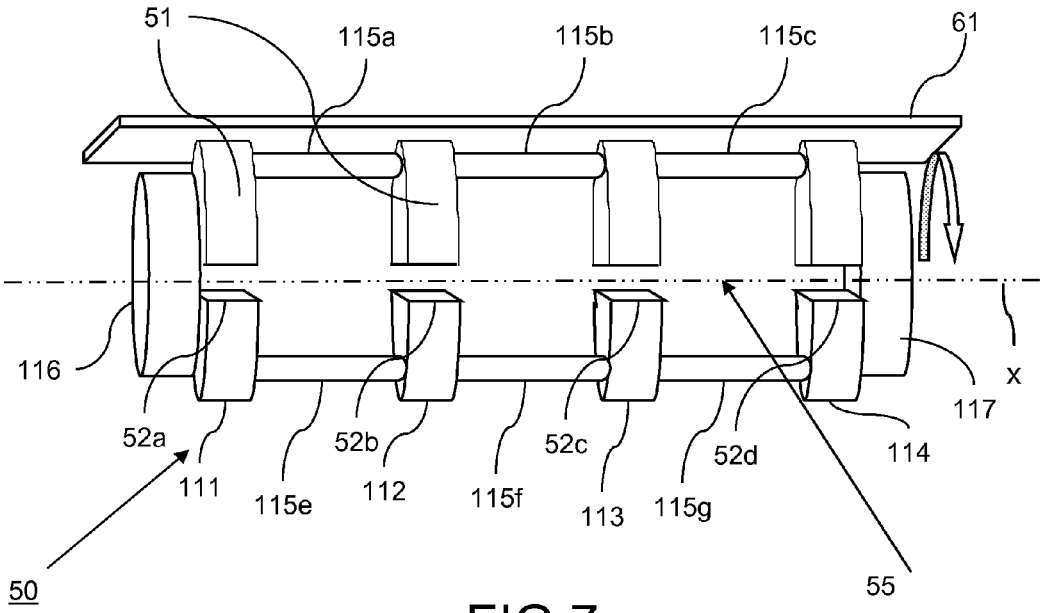
FIG. 7 shows a three-dimensional impression of the construction of the rotatable guiding means according to the eighth embodiment of the invention.

FIG. 7 shows a three-dimensional impression of the construction of the rotatable guiding means 50 and urging means 61 according to the eighth embodiment. In FIG. 7 the rotatable guiding means 50 comprises a plurality of rotational guide elements 111-114. The plurality of rotational guide elements 111-114 is arranged sectional along the rotational axis x. The plurality of rotational guide elements 111-114 is connected to each other by rods 115*a*-115*f*. Each of the plurality of rotational guide elements 111-114 comprises an outer surface 51, a supporting surface 52*a*-52*d* and a sheet deflecting surface (not shown). The urging means 61 is urged against the outer surfaces 51 of each of the plurality of rotational guide elements 111-114.

The plurality of rotational guide elements 111-114 together provides a passageway 55 for a sheet. The rotational guiding means 50 further comprises two brackets 116, 117 both being connected to one of the rotational guide element. The bracket 117 is rotationally driven by a driving means (not shown). By controllably rotating bracket 117 the plurality of rotational guide elements 111-114 are also controllably rotated.

Figure 8:
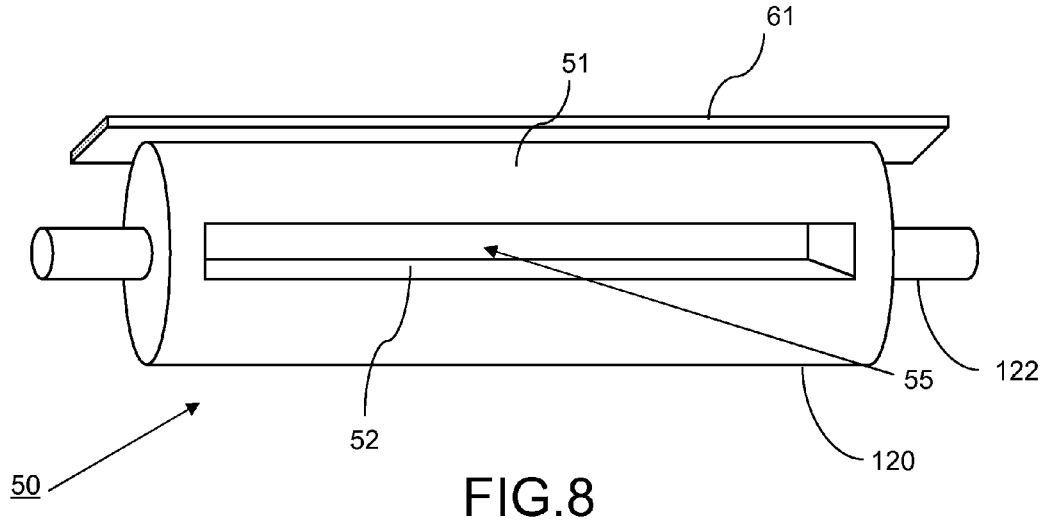
FIG. 8 shows a three-dimensional impression of the construction of the rotatable guiding means according to the ninth embodiment of the invention.

FIG. 8 shows a three-dimensional impression of the construction of the rotatable guiding means 50 and urging means 61 according to the ninth embodiment in a home position. In FIG. 8 the rotatable guiding means 50 comprises an element 120 and a shaft 122. The element 120 comprises an outer surface 51 and a sheet deflecting surface (not shown). The urging means 61 is urged against the outer surface 51 of the element 120. The element provides a passageway 55 and a supporting surface 52 for supporting an enclosed portion of a sheet in home position. The element 120 may be obtained by extrusion process. Driving means (not shown) are provided to controllably rotate shaft 122, thereby rotating the rotatable guiding means 50.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet retention device for retaining at least one sheet, the sheet retention device comprising:

a sheet supporting means for supporting at least a first portion of the sheet, a rotatable guiding means configured to enclose a second portion of the sheet, the rotatable guiding means comprising an outer surface and a sheet deflecting surface, such that in operation during at least part of a revolution of the rotatable guiding means a portion of the sheet is guided by the sheet deflecting surface into a sheet retaining position, which sheet retaining position is defined by the outer surface of the rotatable guiding means and an urging means, the urging means being urged against a portion of the outer surface of the rotatable guiding means in said sheet retaining position, and a drive means for in operation controllably rotating the rotatable guiding means, wherein the rotatable guiding means comprises a passageway arranged through the rotatable guiding means, which passageway is configured to enclose the second portion of the sheet, the passageway having an entrance portion at one side of the outer surface of the rotatable guiding means and an exit portion at another side of the outer surface of the rotatable guiding means, said exit portion being arranged in the passageway at an opposite end with respect to the entrance portion.

2. The sheet retention device according to claim 1, further comprising a sheet feeding means configured for in operation feeding a sheet in a feeding direction into the rotatable guiding means and through the passageway, the sheet feeding means is arranged upstream of the rotatable guiding means with respect to the feeding direction.

3. The sheet retention device according to claim 2, wherein in operation the exit portion of the passageway is arranged downstream with respect to the entrance portion of the passageway in the feeding direction of the sheet through the passageway.

4. The sheet retention device according to claim 1, further comprising a sheet transporting means configured for transporting a sheet in the rotatable guiding means through the passageway wherein the sheet transporting means is arranged inside of the rotatable guiding means.

5. The sheet retention device according to claim 2, further comprising control means for controlling the sheet feeding means and the drive means such that in operation the sheet feeding means is able to feed the second portion of the sheet into the rotatable guiding means.

6. The sheet retention device according to claim 1, further comprising detecting means, being configured to detect a position of the sheet.

7. The sheet retention device according to claim 1, wherein the device is configured to stack a plurality of sheets in the retaining position of the sheet retention device.

8. The sheet retention device according to claim 1, wherein the sheet deflecting surface is adjoined with the outer surface of the rotatable guiding means.

9. The sheet retention device according to claim 8, wherein at least a portion of the sheet deflecting surface is provided by an outer surface of a trundle, which sheet deflecting surface extends beyond an adjoining portion of the outer surface of the rotatable guiding means.

10. The sheet retention device according to claim 1, wherein the rotatable guiding means comprises at least two plates, which at least two plates provide the outer surface and the deflecting surface of the rotatable guiding means, and two brackets enclosing the at least two plates.

11. The sheet retention device according to claim 1, wherein the rotatable guiding means comprises a plurality of rotational guide elements, the plurality of rotational guide elements being arranged sectional along the rotational axis of the rotatable guiding means, wherein a rotational movement of each of the rotational guide elements is connected to the rotational movement of the rotatable guiding means.

12. A sheet processing device comprising a feeding station for feeding a sheet, a sheet retention device according to claim 1 for retaining at least one sheet and a sheet delivery station for delivering at least one processed sheet.

13. A printing system comprising a sheet storage module for storing a plurality of sheets, a marking station for marking a sheet, which is fed from the sheet storage module, and a sheet retention device according to claim 1 for retaining at least one processed sheet.

14. Method for retaining at least one sheet in a sheet retention device, the sheet retention device comprising a rotatable guiding means, wherein the rotatable guiding means comprises an outer surface and a passageway, which is arranged through the rotatable guiding means, the passageway having an entrance portion at one side of the outer surface of the rotatable guiding means and an exit portion at another side of the outer surface of the rotatable guiding means, said exit portion being arranged in the passageway at an opposite end with respect to the entrance portion, the method comprising the steps of:

a) feeding a first portion of a sheet in a feeding direction into the entrance portion of the passageway and through the passageway of the rotatable guiding means such that the first portion of the sheet is supported by a sheet supporting means, which is arranged adjacent to the exit portion of the passageway, and a second portion of the sheet is enclosed by the passageway of the rotatable guiding means, b) urging an urging means against a portion of said outer surface of the rotatable guiding means, thereby defining a sheet retaining position, and c) rotating the rotatable guiding means, such that a portion of the sheet is guided into the sheet retaining position.

15. The method according to claim 14, wherein prior to step a) the rotatable guiding means is arranged in a home position being suitable for feeding a second portion of the sheet into the passageway of the rotatable guiding means.

16. The method according to claim 14, further comprising step d) holding the supported first portion of the sheet fixed with respect to the sheet supporting means.

17. The method according to claim 14, wherein the rotatable guiding means further comprises a deflecting surface and during step c) the deflecting surface is moved along the sheet retaining position thereby guiding a portion of the sheet into the sheet retaining position.

18. The method according to claim 14, further comprising step e) detecting the sheet, and wherein step a) further comprises controlling the position of the detected sheet with respect to the sheet supporting means.

19. The method according to claim 14, wherein step a) and/or step c) are carried out multiple times such that a plurality of sheets is stacked in the sheet retaining position, prior to releasing the stacked plurality of sheets from the sheet retaining position.

* * * * *